US008841829B2

(12) United States Patent
Koch et al.

(10) Patent No.: US 8,841,829 B2
(45) Date of Patent: Sep. 23, 2014

(54) LAMP HOLDER AND LAMP BASE FOR A GAS DISCHARGE LAMP

(75) Inventors: Bernd Koch, Berlin (DE); Joachim Mühlschlegel, Gröbenzell (DE)

(73) Assignee: OSRAM GmbH, Munich (DE)

( * ) Notice: Subject to any disclaimer, the term of this patent is extended or adjusted under 35 U.S.C. 154(b) by 92 days.

(21) Appl. No.: 13/384,587

(22) PCT Filed: Jun. 9, 2010

(86) PCT No.: PCT/EP2010/058096

§ 371 (c)(1),
(2), (4) Date: Jan. 17, 2012

(87) PCT Pub. No.: WO2011/006715

PCT Pub. Date: Jan. 20, 2011

(65) Prior Publication Data

US 2012/0135638 A1 May 31, 2012

(30) Foreign Application Priority Data

Jul. 16, 2009 (DE) ..... 10 2009 033 454

(51) Int. Cl.
*H01J 5/48* (2006.01)
*H01J 5/50* (2006.01)

(52) U.S. Cl.
USPC ..... 313/318.01; 313/318.07; 313/492; 313/238; 313/242

(58) Field of Classification Search
USPC ..... 313/318.01, 318.07, 492, 580, 626, 313/238–240, 242
See application file for complete search history.

(56) References Cited

U.S. PATENT DOCUMENTS

| | | | | |
|---|---|---|---|---|
| 2,205,502 | A | 6/1940 | Tromp | |
| 6,544,059 | B1 * | 4/2003 | Clavier et al. | 439/182 |
| 2002/0093279 | A1 * | 7/2002 | Chen | 313/318.01 |
| 2008/0238291 | A1 * | 10/2008 | Nagasawa et al. | 313/490 |
| 2010/0133982 | A1 * | 6/2010 | Bembridge et al. | 313/318.01 |

FOREIGN PATENT DOCUMENTS

| | | |
|---|---|---|
| DE | 764 008 | 8/1968 |
| EP | 1 063 729 | 12/2000 |

* cited by examiner

*Primary Examiner* — Anh Mai
*Assistant Examiner* — Kevin Quarterman
(74) *Attorney, Agent, or Firm* — Cozen O'Connor

(57) ABSTRACT

A lamp holder (61) for a gas discharge lamp (5), having at least two receptacles (B1, B2) for at least two pins (P1, P2) of a gas discharge lamp (5), wherein at least one shielding conductor (S1*a*, S1*b*, S2*a*, S2*b*) is disposed in the vicinity of each receptacle (B1, B2).

20 Claims, 7 Drawing Sheets

LAMP HOLDER AND LAMP BASE FOR A GAS DISCHARGE LAMP

RELATED APPLICATIONS

This is a U.S. national stage of application No. PCT/EP2010/058096, filed on Jun. 9, 2010.

This application claims the priority of German application no. 10 2009 033 454.8 filed Jul. 16, 2009, the entire content of which is hereby incorporated by reference.

FIELD OF THE INVENTION

The invention relates to a lamp holder system having a lamp holder and a lamp base for a gas discharge lamp, comprising at least two receptacles for at least two pins of a gas discharge lamp.

BACKGROUND OF THE INVENTION

Gas discharge lamps as shown in FIG. 9 are known in which the base is formed directly from the glass of the outer bulb of the gas discharge lamp. The base essentially consists of the outside contour of the pinch of the outer bulb of the gas discharge lamp from which the two pins of the gas discharge lamp project, these being used as pins for receptacles of a corresponding lamp holder. For manufacturing related reasons, these pins have a small diameter because of the glass pinch and may have sharp edges at their ends. Due to the manufacturing process, the glass base has a straight edge between the pins. Particularly in the case of low wattage lamps, the spacing between the pins is often so small that a flashover path can form here along the edge of the glass base. Increasing the insulation barrier is difficult to implement for manufacturing related reasons.

However, the gas discharge lamps can also have a ceramic base as shown in FIG. 10. Of course the base does not necessarily have to consist of ceramic, but can be made of many other suitable materials, e.g. special high-temperature plastics such as PPS (polyphenylene sulfide), PEI (polyetherimide) or LCP. Where a ceramic base is referred to in the following explanations, a base is always meant which can consist of a ceramic or another suitable material. In the lamp base, the pins projecting from the lamp bulb are connected to the base contacts which are used in turn as contacts for a corresponding lamp holder. Although said base contacts can be thicker, i.e. implemented with a larger diameter, this reduces the distance between the inner contact surfaces of the base contacts. With these lamps there is likewise the problem of the thin pins which have a very small spacing. Here, however, the flashover path is inside the lamp base which is normally filled with porous ceramic cement in order to establish a connection between the outer bulb of the gas discharge lamp and the base. However, because of the porous structure, this cement is not high voltage resistant, and there is again the problem of possible flashover because of the high field strength.

A combination of the two cases can of course occur here, i.e. a lamp as in FIG. 10 having a lamp base is inserted in a lamp holder. Here there are two regions at risk, namely on the one hand the region in the lamp base in which a flashover path can form along the lower edge of the outer bulb of the gas discharge lamp and, on the other, the region in the bottom of the lamp holder into which the lamp base is inserted. In the following description, the holder bottom and base bottom are regarded as the lower surface of the cavity and inner contour respectively into which the gas discharge lamp 5 is inserted into the holder or the outer bulb is inserted in the lamp base, as the case may be.

As these gas discharge lamps require a high starting voltage, the problem arises that, if the spacing of the pins is too small, an electrical flashover can be produced between the pins which prevents the lamp system from operating properly. An electrical flashover is known to occur where the field strength is so high that the breakdown strength of the insulator or of the air, as the case may be, is exceeded. The highest field strengths are to be found at sharp edges and vertices, basically at all points on electrical conductors whose surfaces have tight bends or more specifically small radii. The critical areas are the regions in which, without a shielding conductor, a high field strength, i.e. a strongly inhomogeneous field, would occur and in which an undesirable flashover can be produced along a clearance or leakage path. Particularly at risk here are the regions which, because of small radii, have very high field strengths which cannot be shielded by suitable insulation. This is particularly the case in the vicinity of the pins. The region will hereinafter be defined as a critical region. Likewise regarded as critical is the region containing the receptacles in the lamp holder. As these likewise cannot be insulated, an electrical flashover may also be produced here. To sum up, it can therefore be said that, in the following explanations, the area around and particularly between the pins and receptacles of the lamp and lamp base respectively or of the lamp holder will be regarded as the critical region.

The market demands increasingly lower-powered gas discharge lamps with smaller lumen packages which are also increasingly smaller physically because of the lower power. However, many of these low wattage lamps do not have a correspondingly smaller starting voltage. The problem therefore arises that the bases of these gas discharge lamps cannot be miniaturized to the extent that would be desirable, without seriously compromising safety/reliability.

SUMMARY OF THE INVENTION

One object of the invention is to provide a lamp holder system having a lamp holder and a lamp base with at least two receptacles for at least two pins of a gas discharge lamp such that the mutual spacing of the at least two pins can be reduced without compromising safety/reliability.

This object is achieved in accordance with one aspect of the present invention directed to a lamp holder for a gas discharge lamp, having at least two receptacles for at least two pins of a gas discharge lamp, wherein at least one shielding conductor is disposed in the vicinity of each receptacle.

Another aspect of the present invention is directed to a lamp base for a gas discharge lamp having at least two pins, wherein at least one shielding conductor is disposed in the vicinity of each pin. Said shielding is effective in the region in which the pins emerge from the lamp body inside the base, and also in the region in which the base contacts in turn project from the base.

According to an embodiment of the invention, the shielding can of course also be provided for both regions. This is to be understood as meaning that, to achieve the object, either a lamp holder or a lamp base or both together can be provided with the shielding conductor. This is due to the fact that, as already explained in the introduction, there are various types of discharge lamps which, because of the different bases, have to be treated differently in order to embody the inventive design.

Homogenization of the electric field is to be understood as making the field uniform and therefore reducing the electric field strength. By means of the shielding conductors, the electric field is simultaneously widened and the high field strength otherwise present at the pins of the gas discharge lamp is 'shifted' onto the shielding conductors. These are, however, embedded in a well insulated manner in the lamp base or the lamp holder, as the case may be, thereby preventing the field strength from producing a flashover effect here. Homogenization the electric field brings about a reduction in the field strength at the pins and therefore prevents an undesirable flashover.

Electrically, the shielding conductor has the same polarity and the same voltage as the associated receptacle or the associated pin, as the case may be. Said shielding conductor is preferably embedded in an electrically insulated manner in the lamp holder or the lamp base, as the case may be, such that the electric field strength on the surface of the lamp holder or on the surface of the lamp base, as the case may be, is less than a critical field strength. Said critical field strength is, for example, the field strength at which an undesirable flashover between the pins can occur in air. This avoids electrical flashovers and improves operating reliability/safety.

The receptacles of the lamp holder or the leads in the lamp base, as the case may be, are preferably overtopped by the shielding conductors in the insertion axis by a predetermined height relative to the base bottom or the holder-bottom, as the case may be. The case of a lateral pinch is also conceivable.

Here the shielding conductors must extend beyond the lead in the direction of the leads in the pinch. The base bottom and the holder bottom are the bottom surface of the cavity in the lamp base and lamp holder respectively into which the gas discharge lamp burner or the gas discharge lamp (with base), is inserted or plugged. The term leads here means the components which emerge from the gas discharge lamp burner and are connected to the pins of the base. Said leads are to be overtopped by a predetermined height so that the shielding conductor overlaps the region in which the lead is surrounded by the insulation of the pinch. In the design as a lamp holder this means that the shielding conductors extend beyond the sockets of the holder, likewise an improvement of the breakdown strength for the case that there is no lamp in the holder.

In the X-axis direction, the surface of the at least one shielding conductor is preferably placed a certain distance in front of the surface of the associated pin in the direction of the opposite pin. For the first offset distance, $-0.25\ dp<dx<0.5\ dp$ preferably applies, with particular preference $0.05\ dp<dx<0.4\ dp$, where dp is the spacing of the at least two pins. In addition, the surface of the at least one shielding conductor is preferably offset outward by a second distance in the direction of the Y-axis relative to the surface of the associated pin. For the second offset distance dy, $dy<1.5\ dp$ applies, with particular preference $dy<0.8\ dp$, where dp is the spacing of the at least two pins. This measure makes it possible to dispose the shielding conductors around the lamp base or the outer bulb, as the case may be, of the lamp. Said shielding conductors can be made from a wire, a tube, a sheet metal stamping or an electrically conducting casting, depending on the application and manufacturing process of the gas discharge lamp or of the gas discharge lamp base, as the case may be.

In another preferred embodiment, in the case of two shielding conductors assigned to a pin or rather of an even number of shielding conductors assigned to a pin, these are disposed axisymmetrically with respect to the X-axis. In particular cases, it may also be advisable to additionally or alternatively dispose the shielding conductor axisymmetrically with respect to the Y-axis, thereby enabling the field strength at the pins or the receptacles, as the case may be, to be reduced still further.

BRIEF DESCRIPTION OF THE DRAWING(S)

Further advantages, features and details of the invention will be explained in the following description of exemplary embodiments with reference the accompanying drawings in which the same or functionally identical elements are provided with identical reference characters:

Figure 11:
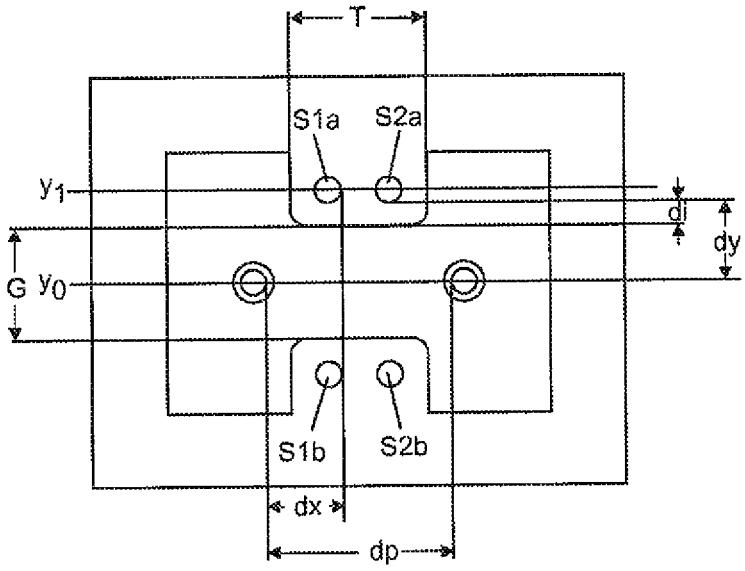
Figure 12:
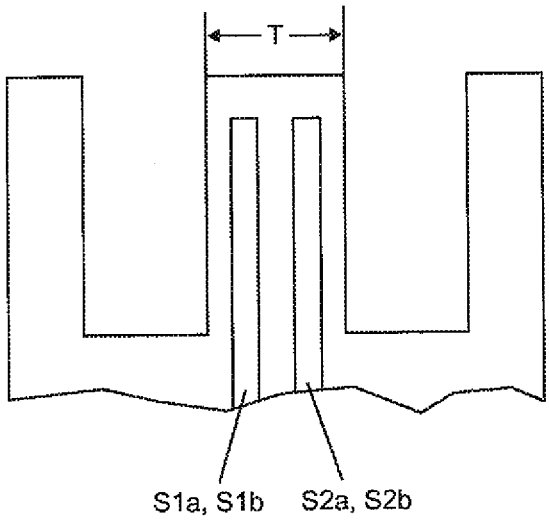

FIG. 11 shows the view from above into a G8.5 holder modified in accordance with an embodiment of the invention. The holder geometry conforms to IEC 60061-1, sheet 7005-122-1; and FIG. 12 shows the section along the line marked y1 of the G8.5 holder shown in FIG. 11. The shielding conductors S1*a*, S1*b*, S2*a* and S2*b* are completely insulated by the ceramic holder, but connected to the associated sockets.

PREFERRED EMBODIMENT OF THE INVENTION

Figure 1:
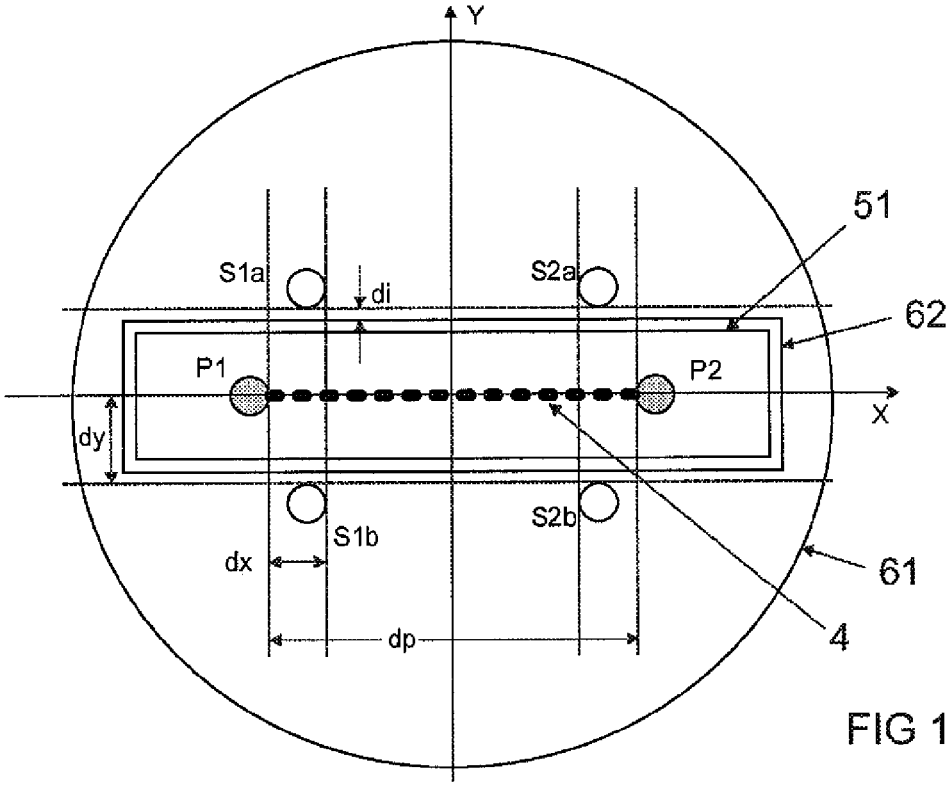
FIG. 1 shows a plan view of a lamp base for a gas discharge lamp or a lamp holder according to a first embodiment of the invention in which two shielding conductors are assigned to a receptacle or to a pin.

FIG. 1 shows a plan view of an inventive lamp base 61 for a gas discharge lamp 5 or an inventive lamp holder 61, as the case may be, in a first embodiment in which two shielding conductors S1*a*, S1*b* are assigned to a receptacle B1 or to a pin P1, as the case may be, and S2*a*, S2*b* are assigned to a receptacle B2 or to a pin P2 as the case may be.

In the following explanations, basically three cases will be considered for which the explanations are intended to apply.

Figure 8:
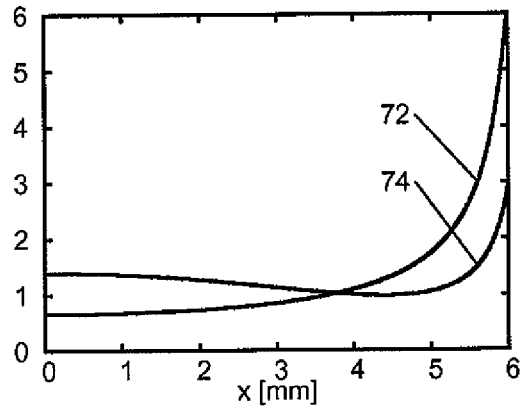
FIG. 8 shows a representation of the absolute value of the electric field along the X-axis.

In the first case, a gas discharge lamp 5 according to FIG. 8 is considered, wherein the lamp base is made of glass, and which is inserted into a corresponding lamp holder. The shielding conductors S1*a*, S1*b*, S2*a*, S2*b* are here accommodated in the lamp holder, the glass base is unsuitable for accommodating shielding conductors. The fundamental problem of these lamps is always that the pins P1, P2 brought out of the glass are often disposed very close to one another, so that an electrical flashover on a flashover path 4 can be produced between them along the lower edge of the glass base. This is due to the fact that, because of the manufacturing restrictions, the pins P1, P2 must be very thin in the case of a glass base. As a result, the field strength at these pins is very high and a flashover can very easily occur along this flashover path 4.

Figure 9:
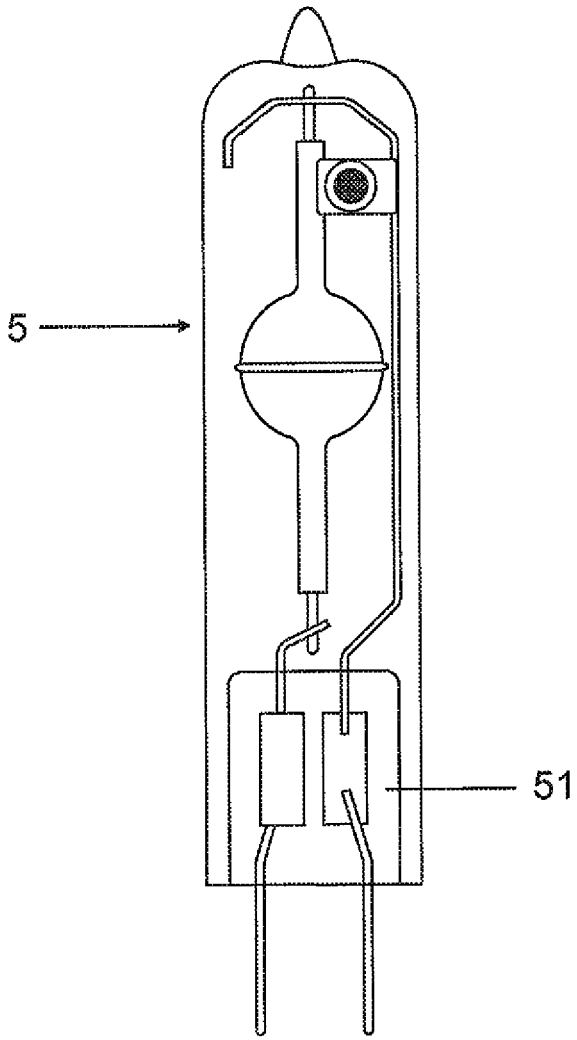
FIG. 9 shows a view of a prior art gas discharge lamp with a glass base.

In the second case, a gas discharge lamp 5 according to FIG. 9 is considered which has a ceramic base into which the outer W bulb of the gas discharge lamp 5 is embedded. The connection between the outer bulb of the gas discharge lamp and the base 61 has the same problem, as here too the leads of the outer bulb must be connected to the pins of the base 61 from the outer bulb of the gas discharge lamp with its bottom glass termination, and a similar flashover path 4 can likewise form here. This then runs inside the base 61 which is normally filled with porous ceramic cement. The cement establishes the connection between the gas discharge lamp burner and the base. However, the cement is so porous that it does not have an electrically insulating effect.

Figure 10:
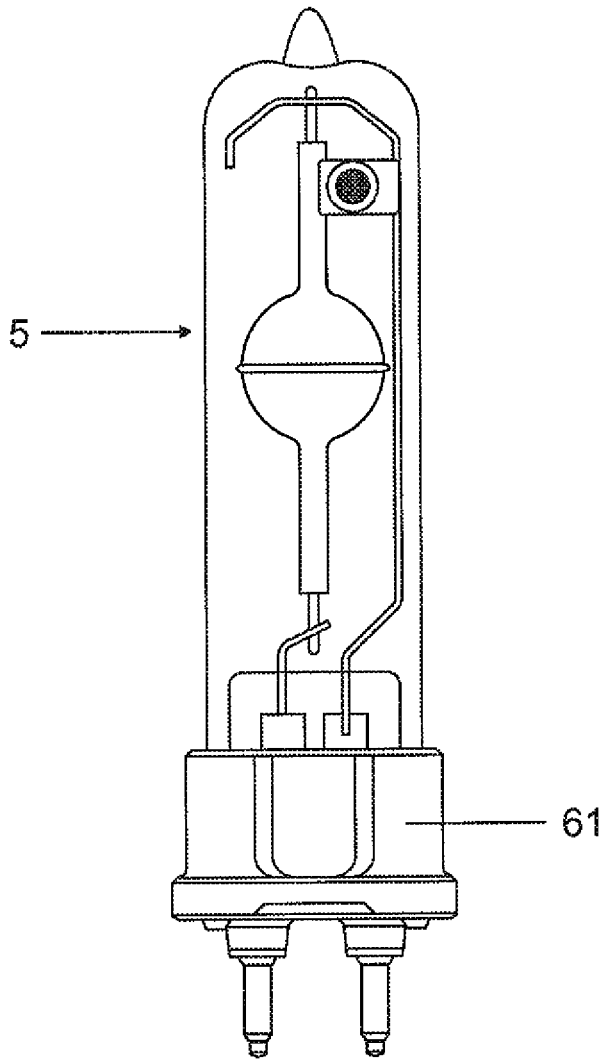
FIG. 10 shows a view of a prior art gas discharge lamp with a ceramic base.

The third case is a combination of the first two cases wherein a gas discharge lamp 5 according to FIG. 10 is inserted into an inventive holder 61. Here shielding conductors S1*a*, S1*b*, S2*a*, S2*b* can be present in the base of the gas discharge lamp 5 and in the lamp holder 61 in order to homogenize the electric field in the corresponding region.

The mechanical design of the lamp base 61 or lamp holder 61, as the case may, be will now be described. To simplify the description, three spatial axes intended to illustrate the mechanical relationships will be defined in the following exposition. The X-axis runs in the following FIGS. 1-4 through the connecting line between the two pins P1 and P2, the origin lying centrally between the pins. The Y-axis runs perpendicular to the X-axis through the origin of the X-axis on the plane of the base bottom or holder bottom, as the case may be. Lastly, the Z-axis likewise runs through the X- and Y-axis and in the insertion direction, i.e. the insertion axis of the lamp, perpendicular to the X- and Y-axis.

As can be seen from FIG. 1, the shielding conductors are disposed in a certain manner relative to the pins. They are basically offset in the direction of the X- and Y-axis relative the pins or the receptacles, as the case may be. The offsetting of the shielding conductor in the direction of the X-axis causes the field strength around the pin P1, P2 or around the receptacle B1, B2, as the case may be, to be reduced. This is caused by the homogenization undergone by the electric field due to the presence of the shielding conductors. Homogenization means here that the field strength distribution in the critical region is very uniform, irrespective of whether the pins have a small diameter or sharp edges. This is caused by the shielding conductors which flank the pins and therefore continue the electric field beyond the pins. The high field strengths are therefore only produced in the vicinity of the shielding conductors. However, by being embedded in the lamp base or lamp holder, as the case may be, the shielding conductor S1*a*, S1*b*, S2*a*, S2*b* are very well insulated, so the high field strengths cannot cause any damage here. In order to be able to ensure this, the insulation around the shielding conductors must have a minimum thickness. The point where the insulation is at its thinnest is normally between the surface of the shielding conductor and the adjacent wall of the base cavity in which the gas discharge lamp or the outer bulb of the gas discharge lamp, as the case may be, is inserted. The base ceramic here has a thickness di which must not fall below a critical thickness $d_{krit}$ in order, on the one hand, to prevent the field strength on the surface of the base ceramic from becoming too high and, on the other, also to enable reliable flashover protection to be ensured. Due to the insulation, the resulting field strength on the shielding conductors is relatively uncritical. For the manufacture of the shielding conductors, it is therefore unnecessary to take special design measures to ensure that the field strength on them is kept particularly low, and so, contrary to the illustrations in the Figures, the shielding conductors can also be made e.g. from sheet metal stampings, metal castings or the like. The shielding conductors can of course, as indicated in the Figures, likewise consist of round stock. However, it is irrelevant if, because of automated machining operations, they have sharp edges and burrs, e.g. caused by cutting to length or bending. The shielding conductors can of course also be made from round stock which is machined according to the mechanical requirements.

Relative to the assigned pin in the direction of the X-axis, i.e. in the direction of the connecting line between the two pins P1 and P2, the shielding conductors S1*a*, S1*b*, S2*a*, S2*b* are disposed offset by the distance dx toward the unassigned pin (P2 for S1*a*, S1*b* and P1 for S2*a*, S2*b*). The distance dx is measured from outer surface to outer surface. The shielding conductors are each offset outward away from the connecting line of the pins by the distance dy in the Y-axis direction, said distance dy being measured from the center point of the pins P1, P2 to the outer surface of the shielding conductors S1*a*, S1*b*, S2*a*, S2*b*. The offset in the Y-axis direction is necessary in order to take the shielding conductors out of the region of the inner cavity of the lamp base or lamp holder, as the case may be, into which the outer bulb of the gas discharge lamp 5 or the gas discharge lamp 5, as the case may be, is inserted. The offset in the Y-axis direction is preferably minimized, as it contributes little to the homogenization of the electric field, indeed generally even makes the conditions worse. The shielding conductors have the same voltage and the same polarity as the pins to which they are assigned. The same voltage is to be understood as meaning that the shielding conductors do not need to have precisely the same voltage as the pins or the receptacles, as the case may be. The shielding conductors rather have a voltage of the same polarity and the same order of magnitude or higher. The shielding conductors S1*a*, S1*b* are preferably directly coupled to the pin P1, and the shielding conductor S2*a*, S2*b* are directly coupled to the pin P2. However, it is also conceivable for the shielding conductors to be capacitively coupled to the pins.

The purpose of the arrangement is to enable the flashover path 4 to be kept as small, i.e. short, as possible. This means that the spacing of the pins P1, P2 and therefore also the spacing of the receptacles B1, B2 in the lamp holder can be kept as small as possible. This is indispensable for successful miniaturization of the lamp base or lamp holder, as the case may be. The fact that the distance between the shielding conductors S1*a*, S1*b* and the shielding conductors S2*a*, S2*b* is here less than the spacing of the pins P1, P2, does not pose a problem, as the shielding conductors S1*a*, S1*b*, S2*a*, S2*b* are preferably completely embedded in the base or holder material, as the case may be. Said shielding conductors S1*a*, S1*b*, S2*a*, S2*b* are preferably embedded in the lamp base or the lamp holder, as the case may be, such that the voltage present between the pins P1, P2 can be reliably insulated. The thickness of the base material or holder material, as the case may be, around the shielding conductor S1*a*, S1*b*, S2*a*, S2*b* has, as explained above, a minimum thickness di which is greater than a critical thickness $d_{krit}$, thereby reducing the field strength on the surface of the base or holder material, as the case may be, at this point to the extent that it remains below a critical field strength. Said critical field strength is e.g. the field strength at which an undesirable flashover between the pins can occur in air. Self-evidently, any relevant parameters such as atmospheric pressure and humidity must be taken into account. The critical thickness $d_{krit}$ must be adapted to suit the holder system. It is approximately 1 mm in current holder systems.

Figure 2:
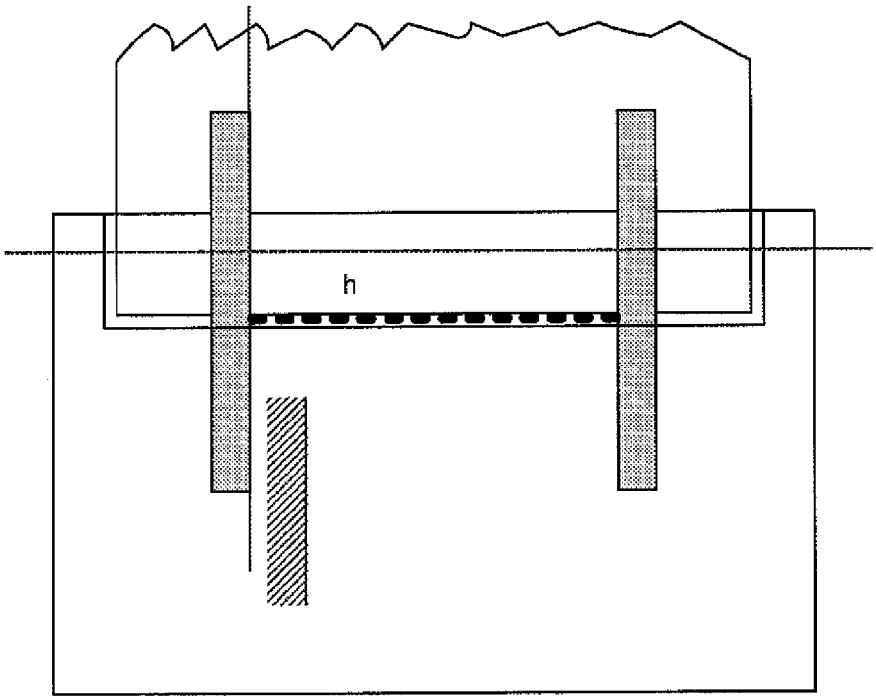
FIG. 2 shows a side view of a lamp base for a gas discharge lamp or a lamp holder according to the first embodiment of the invention in which two shielding conductors are assigned to a receptacle or to a pin.

FIG. 2 shows a side view of an inventive lamp base 61 for a gas discharge lamp 5 or an inventive lamp holder 61, as the case may be, in a first embodiment in which two shielding conductors S1*a*, S1*b*, S2*a*, S2*b* are assigned to a receptacle B1, B2 or to a pin P1, P2, as the case may be. In this figure it can be seen that the shielding conductors S1*a*, S1*b*, S2*a*, S2*b* are disposed offset by a height h with respect to the base or holder bottom, as the case may be, in the direction of the Z-axis, i.e. they are disposed higher than the base or holder bottom. The Z-axis here runs in the direction in which, as the case may be, the gas discharge lamp 5 is inserted in the holder, or in which the outer bulb of the gas discharge lamp is inserted in the base during assembly. This arrangement makes a significant contribution to homogenizing the electric field since, because of the higher arrangement, the shielding conductors S1*a*, S1*b*, S2*a*, S2*b* are fully effective in the particularly critical region in which the pins P1, P2 come into contact with the receptacles B1, B2 for the first time on insertion in the lamp holder.

Also for the second or third case in which a gas discharge lamp 5 with a ceramic base is used, the higher disposition of the shielding conductors S1*a*, S1*b*, S2*a*, S2 relative to the base bottom has advantages. Especially in the lamp base, the connections between the pins of the gas discharge lamp 5 and the leads of the outer bulb of the gas discharge lamp 5 are disposed at the level of the base bottom. These connections often have sharp-edged corners and burrs where very high field strengths can occur. Here the inventive shielding conductors S1*a*, S1*b*, S2*a*, S2*b* help significantly to prevent flashovers in this region. Due to the fact that the shielding conductors are inventively disposed higher, the homogenization is particularly good in the lower-lying critical region. If the shielding conductor were not disposed higher than the pins, the inventive effect would barely occur or in particular cases would not even be produced at all.

Figure 3:
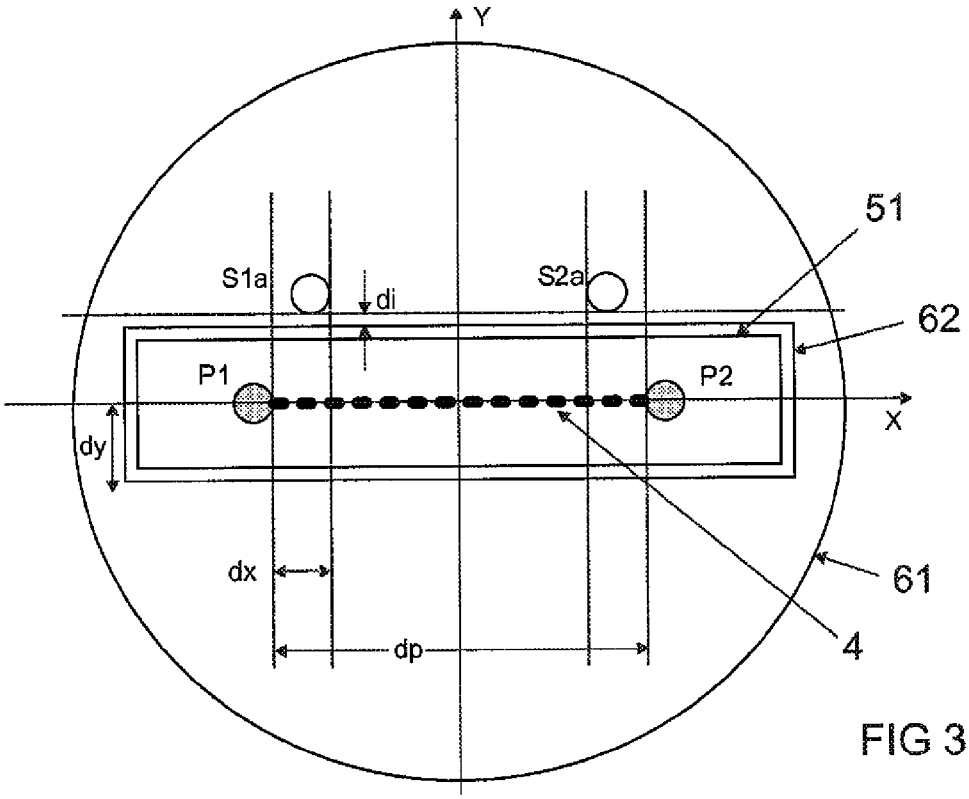
FIG. 3 shows a plan view of a lamp base for a gas discharge lamp or a lamp holder according to the second embodiment of the invention in which one shielding conductor is assigned to a receptacle or to a pin.

FIG. 3 shows a plan view of an inventive lamp base for a gas discharge lamp or an inventive lamp holder, as the case may be, in a second embodiment in which one shielding conductor S1*a*, S2*a* is assigned to a receptacle B1, B2 or to a pin P1, P2, as the case may be. As the second embodiment is similar to the first embodiment, only the differences compared to the first embodiment will be explained here. The second embodiment differs from the first embodiment in that each pin P1, P2 is assigned only one shielding conductor S1*a*, S2*a*. The overall design is therefore simpler and less expensive. The spacing between the surfaces of the pins P1, P2 is here likewise denoted by dp, the shielding conductors S1*a*, S2*a* are placed a distance dx in front of the pin in the X-axis direction and offset by the distance dy in the Y-axis direction. They are likewise embedded in the lamp holder 61 or the lamp base 61, as the case may be, in order to prevent a flashover from shielding conductor to shielding conductor or from shielding conductor to pin. The minimum insulation thickness between a shielding conductor and the critical region is here di. This insulation thickness must likewise be above the critical insulation thickness $d_{krit}$.

Figure 4:
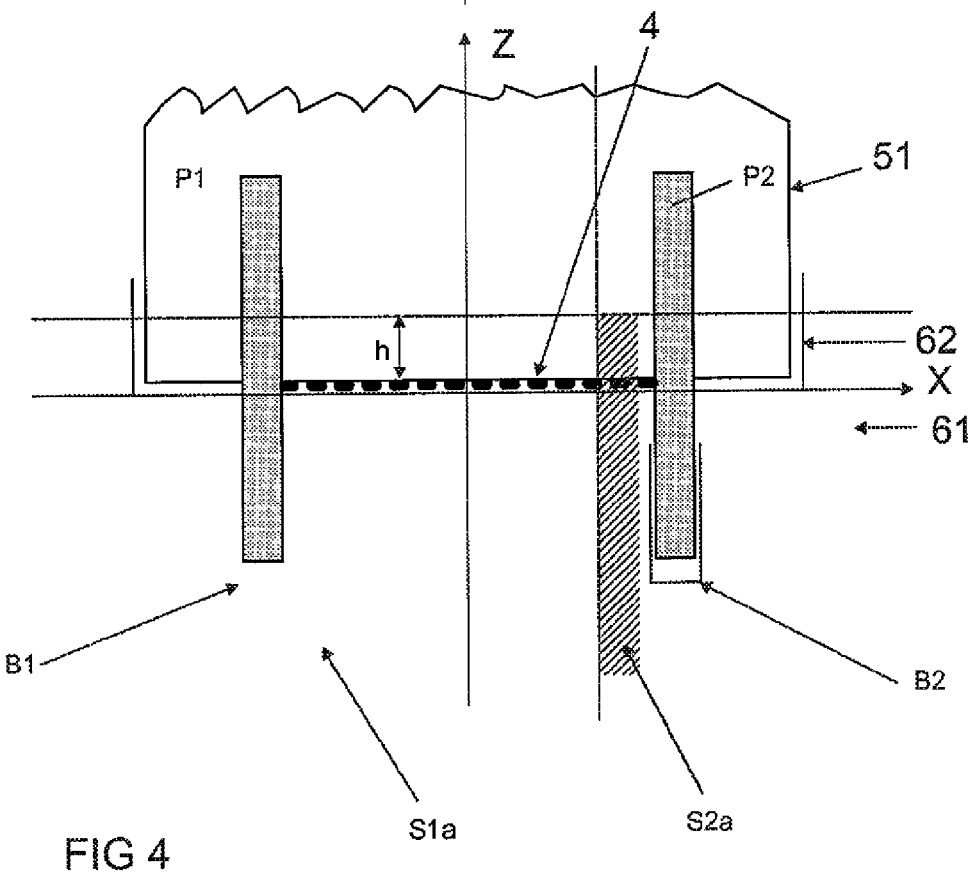
FIG. 4 shows a side view of a lamp base for a gas discharge lamp or a lamp holder according to the second embodiment of the invention in which one shielding conductor is assigned to a receptacle or to a pin.

FIG. 4 shows a side view of an inventive lamp base 61 for a gas discharge lamp 5 or an inventive lamp holder 61, as the case may be, in a second embodiment in which one shielding conductor S1*a*, S2*a* is assigned to a receptacle B1, B2 or to a pin P1, P2, as the case may be. Here too there is little to add to the comments relating to FIG. 2. The shielding conductors are again disposed offset upward by the height h so that their upper end is positioned above the base bottom. The upper end of the receptacle B1, B2 is therefore in the upper half of the shielding conductors, so the homogenizing effect of the shielding conductors is brought fully to bear on the electric field in this plane.

Figure 5:
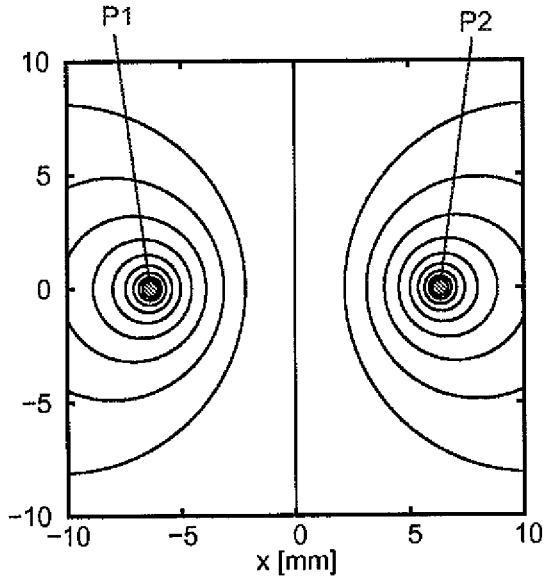
FIG. 5 shows a representation of the potential between the pins of a gas discharge lamp in an arrangement according to the prior art.

FIG. 5 shows a representation of the potential between the pins of the gas discharge lamp in a prior art arrangement. This representation enables the field strength at a certain position to be implicitly discerned. The lines propagating around the two pins are equipotential lines. These lines indicate the locations where the same electrical potential is present. The regions where the equipotential lines are close together are the regions that have a high field strength. It may clearly be seen that the field strength is very high between the pins in the vicinity of the pins. There is therefore a major risk of flashover here.

Figure 6:
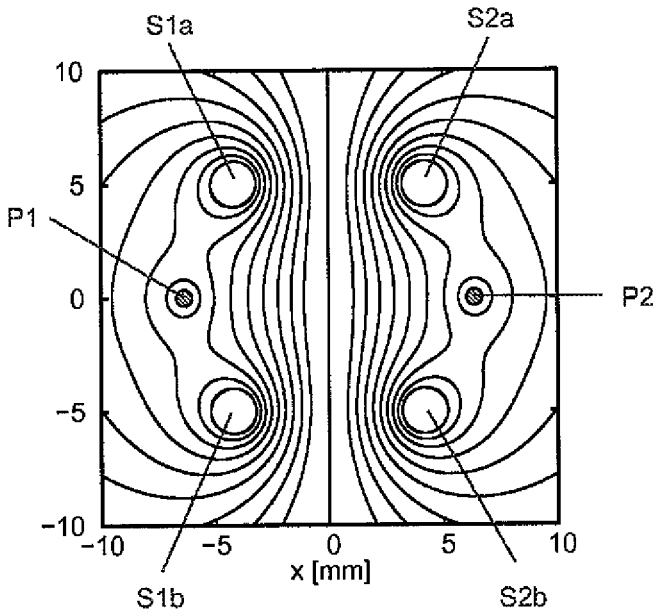
FIG. 6 shows a representation of the potential between the pins of a gas discharge lamp in an arrangement according to the invention in the first embodiment.

FIG. 6 shows a representation of the potential between the pins of a gas discharge lamp for an inventive arrangement in the first embodiment. It can be clearly seen that the conditions change significantly here with the shielding conductors S1*a*, S1*b*, S2*a*, S2*b* present. The regions where the equipotential lines are close together, indicating a high field strength, are now without exception at the shielding conductors S1*a*, S1*b*, S2*a*, S2*b*, and no longer at the pins P1, P2. This diagram can of course likewise apply to a lamp holder having the receptacles B1, B2 instead of the pins P1, P2. The pins P1, P2 are so well shielded by the shielding conductors S1*a*, S1*b*, S2*a*, S2*b* placed in front of them in a V-shaped manner that the field strength to which they are exposed is greatly reduced.

Figure 7:
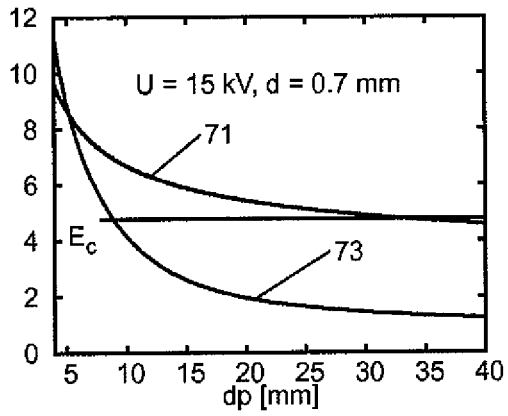
FIG. 7 shows a representation of the absolute value of the maximum electric field strength on the surface of the pins as a function of the spacing of the pins for a pin diameter of 0.7 mm and a voltage between the pins von 15 kV.

This is well illustrated in FIG. 7 which plots the absolute value of the maximum electric field strength in the region of the right-hand pin as a function of the spacing of the pins for a pin diameter of 0.7 mm and a voltage between the pins von 15 kV. The curve 71 shows the field strength without shielding conductors, and the curve 73 the field strength with the inventive shielding conductors. It can be clearly seen that even at small pins spacings the field strength in the inventive solution is significantly lower than in the prior art.

FIG. 8 shows a plot of the electric field along the X-axis.

FIG. 11 shows a top view of an inventive design of a known G8.5 holder. The associated parameters are detailed in the list below. These parameters produce a maximum field strength E on the surface of the pins of E=0.27·U compared to E=0.40·U for a holder according to the prior art, U being the maximum starting voltage applied to the lamp. The reduction in the effective field strength at the pins P1, P2 or receptacles B1, B2, as the case may be, as a result of the inventive design of the holder is therefore 33%. To obtain the same reduction in the prior art design solely by increasing the spacing, the distance between the pins would have to be increased from 7.5 to 23 mm. Conversely, this means that with an inventive design of the G8.5 holder, the same dielectric strength is achieved as is possible using a holder with a pin spacing of 23 mm, thereby enabling it to be replaced by the inventive design of the G8.5 holder. This makes it possible to use a much more compact base/holder system for small gas discharge lamps even at comparatively high starting voltages.

Dimension T: 5.5 mm
Dimension G: 4.5 mm
Pin diameter: 1 mm
Pin spacing: 7.5 mm
Shielding conductor diameter: 1 mm
Distance in front dx: 3 mm Offset dy: 3.25 mm Insulation thickness di: 1 mm FIG. 12 shows the section along the line marked y1 of the inventively modified G8.5 holder. The shielding conductors S1*a*, S1*b*, S2*a* and S2*b* are completely insulated by the ceramic holder. Here it can be clearly seen that the shielding conductors are embedded in the holder such that they project well beyond the base bottom in the insertion direction, thereby ensuring a homogeneous field strength distribution.

List of Reference Characters

4 flashover path

5 gas discharge lamp

51 pinch

61 holder or base

62 inner outline of holder or base

71 curve of field strength on the surface of the pin without shielding conductor

72 curve of field strength along the X-axis without shielding conductor

73 curve of field strength on the surface of the pin with shielding conductor

74 curve of field strength along the X-axis with shielding conductor

P1 first pin

P2 second pin

B1 first receptacle

B2 second receptacle

S1*a* first shielding conductor of first pin

S1*b* second shielding conductor of first pin

S2*a* first shielding conductor of second pin

S2*b* second shielding conductor of second pin

G narrowest point of holder in y-direction, see IEC 60061-2, sheet 7005-122-1

T width in x-direction of narrowest point of holder, see IEC 60061-2, sheet 7005-122-1

The invention claimed is:

1. A lamp holder for a gas discharge lamp, comprising at least two receptacles for at least two pins of a gas discharge lamp, wherein at least one shielding conductor is disposed in the vicinity of each receptacle, wherein the at least one shielding conductor is placed in front of an associated pin in an X-axis direction which runs through a connecting line between the two pins, the origin of the X-axis lying centrally between the pins, and the surfaces of the at least one shielding conductor and of the associated pin pointing in the same direction have a first offset distance.

2. The lamp holder as claimed in claim 1, wherein for the first offset distance (dx) $-0.25\ dp<dx<0.5\ dp$ applies, where dp is the spacing of the at least two pins.

3. A lamp base for a gas discharge lamp, comprising two pins, wherein at least one shielding conductor is disposed in the vicinity of each pin, wherein the at least one shielding conductor is placed in front of an associated pin in an X-axis direction which runs through a connecting line between the two pins, the origin of the X-axis lying centrally between the pins, and the surfaces of the at least one shielding conductor and of the associated pin pointing in the same direction have a first offset distance.

4. The lamp holder as claimed in claim 1, or the lamp base as claimed in claim 3, wherein the at least one shielding conductor is embedded in an electrically insulated manner in the lamp holder or in the lamp base, as the case may be, such that the electric field strength at the surface of the lamp holder or at the surface of the lamp base, as the case may be, is less than a critical field strength.

5. The lamp holder as claimed in claim 1, wherein for the first offset distance (dx) $0.05\ dp<dx<0.4\ dp$ applies, where dp is the spacing of the at least two pins.

6. The lamp holder as claimed in claim 1 or the lamp base as claimed in claim 3, wherein, in a removal direction, the shielding conductors extend beyond the holder bottom or the base bottom, as the case may be, in the direction of a Z-axis running perpendicular to X- and Y-axes.

7. The lamp holder of claim 1 or the lamp base of claim 3, wherein the shielding conductors are made from a wire, a tube, a metal stamping or an electrically conducting casting.

8. The lamp holder as claimed in claim 1, wherein in the case of two shielding conductors assigned to a pin or in the case of an even number of shielding conductors assigned to a pin, as the case may be, these are disposed axisymmetrically with respect to the X-axis.

9. A lamp holder for a gas discharge lamp, comprising at least two receptacles for at least two pins of a gas discharge lamp, wherein at least one shielding conductor is disposed in the vicinity of each receptacle, wherein a surface of the at least one shielding conductor is offset outward with respect to an assigned pin by a second offset distance (dy) in the direction of a Y-axis running perpendicular to an X-axis through the origin of the X-axis on the plane of a holder bottom in the lamp holder.

10. The lamp holder as claimed in claim 9, wherein for the second offset distance (dy) $dy<1.5\ dp$ applies, where dp is a spacing of the at least two pins.

11. The lamp holder as claimed in claim 9, wherein for the second offset distance (dy) $-dy<0.8\ dp$ applies, where dp is a spacing of the at least two pins.

12. The lamp holder as claimed in claim 9, wherein the shielding conductors are disposed axisymmetrically with respect to the Y-axis.

13. The lamp holder as claimed in claim 2 or the lamp base as claimed in claim 3, wherein the at least one shielding conductor is associated with the receptacle or with the pin, as the case may be, which is closest to it, wherein the at least one shielding conductor is electrically connected to an associated receptacle or an associated pin, as the case may be.

14. The lamp base as claimed in claim 3, wherein for the first offset distance (dx) $-0.25\ dp<dx<0.5\ dp$ applies, where dp is the spacing of the at least two pins.

15. The lamp base as claimed in claim 3, wherein for the first offset distance (dx) $0.05\ dp<dx<0.4\ dp$ applies, where dp is the spacing of the at least two pins.

16. The lamp base as claimed in claim 3, wherein in the case of two shielding conductors assigned to a pin or in the case of an even number of shielding conductors assigned to a pin, as the case may be, these are disposed axisymmetrically with respect to the X-axis.

17. A lamp base for a gas discharge lamp, comprising two pins, wherein at least one shielding conductor is disposed in the vicinity of each pin, wherein a surface of the at least one shielding conductor is offset outward with respect to an assigned pin by a second offset distance (dy) in the direction of a Y-axis running perpendicular to an X-axis through the origin of the X-axis in the lamp base.

18. The lamp base as claimed in claim 17, wherein for the second offset distance (dy) $dy<1.5\ dp$ applies, where dp is a spacing of the at least two pins.

19. The lamp base as claimed in claim 17, wherein for the second offset distance (dy) $-dy<0.8\ dp$ applies, where dp is the spacing of the at least two pins.

20. The lamp base as claimed in claim 17, wherein the shielding conductors are disposed axisymmetrically with respect to the Y-axis.

* * * * *